US011291893B2

(12) United States Patent
Chae

(10) Patent No.: US 11,291,893 B2
(45) Date of Patent: Apr. 5, 2022

(54) EDUCATIONAL GOLF CLUB

(71) Applicant: Byung Gon Chae, Cheongju-si (KR)

(72) Inventor: Byung Gon Chae, Cheongju-si (KR)

( * ) Notice: Subject to any disclaimer, the term of this patent is extended or adjusted under 35 U.S.C. 154(b) by 0 days.

(21) Appl. No.: 16/756,847

(22) PCT Filed: Oct. 15, 2019

(86) PCT No.: PCT/KR2019/013462

§ 371 (c)(1),
(2) Date: Apr. 17, 2020

(87) PCT Pub. No.: WO2020/101184

PCT Pub. Date: May 22, 2020

(65) Prior Publication Data

US 2021/0205676 A1 Jul. 8, 2021

(30) Foreign Application Priority Data

Nov. 13, 2018 (KR) ..... 10-2018-0139199

(51) Int. Cl.
*A63B 53/08* (2015.01)
*A63B 60/02* (2015.01)
(Continued)

(52) U.S. Cl.
CPC ..... *A63B 53/08* (2013.01); *A63B 53/02* (2013.01); *A63B 60/02* (2015.10);
(Continued)

(58) Field of Classification Search
CPC ..... A63B 53/08; A63B 53/02; A63B 60/02; A63B 71/0622; A63B 69/3635; A63B 2225/093; A63B 2208/12; A63B 2209/00; A63B 2071/0625; A63B 53/002; A63B 2053/0495
(Continued)

(56) References Cited

U.S. PATENT DOCUMENTS 2,023,131 A * 12/1935 Gibson ..... A63B 60/00 473/318
2,782,035 A * 2/1957 East ..... A63B 60/24 473/297
(Continued)

FOREIGN PATENT DOCUMENTS

JP 2002-306651 A 10/2002
JP 6340182 B2 6/2018
(Continued)

OTHER PUBLICATIONS

International Search Report for PCT/KR2019/013462 dated Jan. 22, 2020 from Korean Intellectual Property Office.

*Primary Examiner* — Sebastiano Passaniti
(74) *Attorney, Agent, or Firm* — Revolution IP, PLLC

(57) ABSTRACT

Disclosed herein is an educational golf club comprising a shaft and a head, wherein the shaft has a weight increasing means disposed therein. The educational golf club according to the present invention is in a wide use since being adjusted in weight or length according to the user's height or age. Additionally, the educational golf club according to the present invention generates a hitting sound from the shaft realistically when the user hits the golf ball to arouse interest in golf.

1 Claim, 2 Drawing Sheets

(51) Int. Cl.
*A63B 53/02* (2015.01)
*A63B 69/36* (2006.01)
*A63B 71/06* (2006.01)

(52) U.S. Cl.
CPC ..... *A63B 69/3635* (2013.01); *A63B 71/0622* (2013.01); *A63B 2071/0625* (2013.01); *A63B 2208/12* (2013.01); *A63B 2209/00* (2013.01); *A63B 2225/093* (2013.01)

(58) Field of Classification Search
USPC ..... 473/326, 333, 297, 288, 304, 306, 292
See application file for complete search history.

(56) References Cited

U.S. PATENT DOCUMENTS 3,231,281 A * 1/1966 Wallo ..... A63B 15/00 473/256
3,625,513 A * 12/1971 Ballmer ..... A63B 60/16 473/310
3,843,135 A * 10/1974 Andrews ..... A63B 60/04 473/305
3,848,737 A * 11/1974 Kenon ..... A63B 55/40 206/315.2
4,165,874 A * 8/1979 Lezatte ..... A63B 60/00 473/291
4,288,075 A * 9/1981 Kaugars ..... A63B 60/00 473/323
4,461,479 A * 7/1984 Mitchell ..... A63B 60/24 473/292
4,541,631 A * 9/1985 Sasse ..... A63B 60/04 473/297
4,840,371 A * 6/1989 Harris ..... A63B 69/3635 446/404
5,082,279 A * 1/1992 Hull ..... A63B 53/00 473/242
5,152,527 A * 10/1992 Mather ..... A63B 60/24 473/291
5,244,209 A * 9/1993 Benzel ..... A63B 60/24 473/297
5,316,300 A * 5/1994 Simmons ..... A63B 60/00 473/318
5,527,038 A * 6/1996 Mabie ..... A63B 60/10 473/232
5,554,078 A * 9/1996 Hannon ..... A63B 60/24 473/292
5,632,691 A * 5/1997 Hannon ..... A63B 60/00 473/292
5,868,633 A * 2/1999 Keheley ..... A63B 69/3635 473/220
6,146,286 A * 11/2000 Masuda ..... A63B 53/10 473/305
6,371,866 B1 * 4/2002 Rivera ..... A63B 53/02 473/288
7,090,589 B2 * 8/2006 Andersen ..... A63B 69/3632 473/256
7,749,091 B2 * 7/2010 Shields ..... G01M 1/365 473/44
10,500,476 B2 * 12/2019 Farr ..... A63D 15/083
2002/0151375 A1 10/2002 Tseng
2003/0027656 A1 * 2/2003 Katsuya ..... A63B 21/0602 473/226
2005/0079923 A1 * 4/2005 Droppleman ..... A63B 60/00 473/287
2010/0184526 A1 * 7/2010 Park ..... A63B 69/3623 473/226

FOREIGN PATENT DOCUMENTS

KR 20-1999-0002293 U 1/1999
KR 20-0345843 Y1 3/2004
KR 10-2004-0083189 A 10/2004
KR 10-2008-0104586 A 12/2008
KR 10-2009-0087318 A 8/2009
KR 10-0910724 B1 8/2009
KR 10-1080443 B1 11/2011
KR 10-1088208 B1 11/2011
KR 10-1700644 B1 1/2017

* cited by examiner

EDUCATIONAL GOLF CLUB

BACKGROUND OF THE INVENTION

Field of the Invention

The present invention relates to an educational golf club.

Background Art

Recently, with improvement of life, interest in golf sports is increasing, the demand for golf products, such as golf clubs, is greatly increasing, and golf education for infants or children is also increasing.

A golf club includes a shaft, a head, and a grip. Most of such golf clubs are manufactured for adults, and are very expensive. It is not suitable for infants or children to use the golf clubs for fun or for practice since the golf clubs are long. Moreover, an accident may happen since the head is made of a metallic material.

In order to solve the problems, recently, golf clubs for infants or children have been developed and used, and such golf clubs for children has high safety since being made of synthetic resin, such as plastic. Such conventional plastic golf club may be easily damaged from shock since being simply manufactured as a toy. There are metallic golf clubs for children, but infants or children do not feel interest in golf and easily get bored since the golf club since driving distance is short when they hit a golf ball. If infants or children hit golf balls manufactured for adults, because it may strain the children's bodies, the golf clubs for infants or children are not suitable for systematic training.

Moreover, the plastic golf club has a limit in satisfying a desire for golf or in developing a talent for golf since lacking a real sense due to the nature of the material.

As an example of conventional golf clubs for children, Korean Patent Publication No. 2004-0083189 discloses a toy golf club. The toy golf club includes a club head made of aluminum, and a shaft of which one side is combined with the club head and the other side is packed with a grip.

Such a toy golf club makes children enjoy playing a golf game realistically, but has several disadvantages in that it has a safety problem for infants or children, who lack alertness, to use since the club head is made of hard aluminum, and in that it is not appropriate for public use since the manufacturing unit price is very high.

Furthermore, infants or children who lack fundamental knowledge about golf need to practice exactly aligning the club head with the golf ball when hitting the golf ball. However, the conventional toy golf club is nothing but a reduction of the golf club for adults. Therefore, it is difficult for infants or children to systematically practice golf.

So, the inventor of the present invention submitted a patent application entitled a 'golf club for children' and obtained a patent registration (Korean Patent No. 10-1700644). Korean Patent No. 10-1700644 discloses a golf club for guiding children to accurately practice a hitting point of a golf ball. However, the golf club for children has several disadvantages in that the golf club is not adjusted in weight and length according to users and in that it has a limit in arousing the children's interest since the golf ball and golf head which are made of a silicon material do not generate a hitting sound when a kid hits the golf ball.

PATENT LITERATURE

Patent Documents

Patent Document 1: Korean Patent Publication No. 10-2004-0083189 A

Patent Document 2: Korean Patent Publication No. 10-2008-0104586 A

Patent Document 3: Korean Patent Publication No. 10-2009-0087318 A

Patent Document 4: Korean Patent No. 10-1080443 B1

Patent Document 5: Korean Patent No. 10-1088208 B1

Patent Document 6: Korean Patent No. 10-1700644 B1

SUMMARY OF THE INVENTION

Accordingly, the present invention has been made to solve the above-mentioned problems occurring in the prior arts, and it is an object of the present invention to provide an educational golf club which is adjusted in weight or length according to a user's height or age.

It is another object of the present invention to provide an educational golf club which generates a hitting sound from a shaft realistically when the user hits a golf ball to arouse interest in golf so that the user can accurately practices golf and maintain a uniform swing pose.

To accomplish the above object, according to the present invention, there is provided an educational golf club including a shaft and a head wherein the shaft has a weight increasing means disposed therein.

Moreover, the weight increasing means is disposed at a lower portion of the shaft.

Furthermore, the weight increasing means includes a first space part formed in the shaft and a heavy body filling the first space part.

Here, the heavy body is made of any one among synthetic resin, metal, wood or stone.

Additionally, the shaft is made of any one among graphene, synthetic resin, and metal.

Here, the head shaft is made of any one among silicon, synthetic resin, and metal.

Meanwhile, the shaft includes a plurality of round bars which are coupled with one another to be adjusted in length.

Moreover, the shaft has a plurality of grooves formed on the outer circumferential surface or the inner circumferential surface thereof in order to adjust the entire weight of the educational golf club.

Meanwhile, the educational golf club further includes a hitting sound generating means arranged below the weight increasing means.

Here, the hitting sound generating means includes a second space part formed in the shaft and an impacting body moving inside the second space part.

Furthermore, the second space part has an impacting protrusion formed at one side thereof to generate a hitting sound when colliding against the impacting body.

Additionally, the second space part is filled with liquid with predetermined weight.

In addition, the hitting sound generating means further includes an elastic member to increase movement speed of the impacting body when a user swings the golf club.

Meanwhile, the shaft and the head are formed in an integral type or in a detachable type.

Here, if the shaft and the head are formed in a detachable type, the shaft has a spiral groove formed at a lower end portion thereof and the head has a spiral thread coupled with the spiral groove.

Moreover, the spiral groove and the spiral thread are formed to be coupled with each other in a direction of a hitting side of the golf head to prevent separation of the shaft from the head when the user swings the golf club.

The educational golf club according to the present invention is in a wide use since being adjusted in weight or length according to the user's height or age.

Additionally, the educational golf club according to the present invention generates a hitting sound from the shaft realistically when the user hits the golf ball to arouse interest in golf.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Hereinafter, an embodiment of the present invention will be described in detail with reference to the accompanying drawings. When it is judged that detailed descriptions of known functions or structures related with the present invention may make the essential points vague, the detailed descriptions of the known functions or structures will be omitted. Moreover, in the description of the present invention, it should be also understood that the expression that some component is "connected" or "combined" with another component means that some component is directly connected or combined with another component, but is connected or combined with another component through a further component unless there is any statement specifically to the contrary.

That is, the terms and words used in the specification and claims must not be limited to typical or dictionary meanings, but must be regarded as concepts selected by the inventor as concepts which best illustrate the present invention, and must be interpreted as having meanings and concepts adapted to the scope and spirit of the present invention to aid in understanding the technology of the present invention.

Therefore, the description of the various embodiments is to be construed as exemplary only and does not describe every possible instance of the invention. Therefore, it should be understood that various changes may be made and equivalents may be substituted for various elements of the invention.

Figure 1:
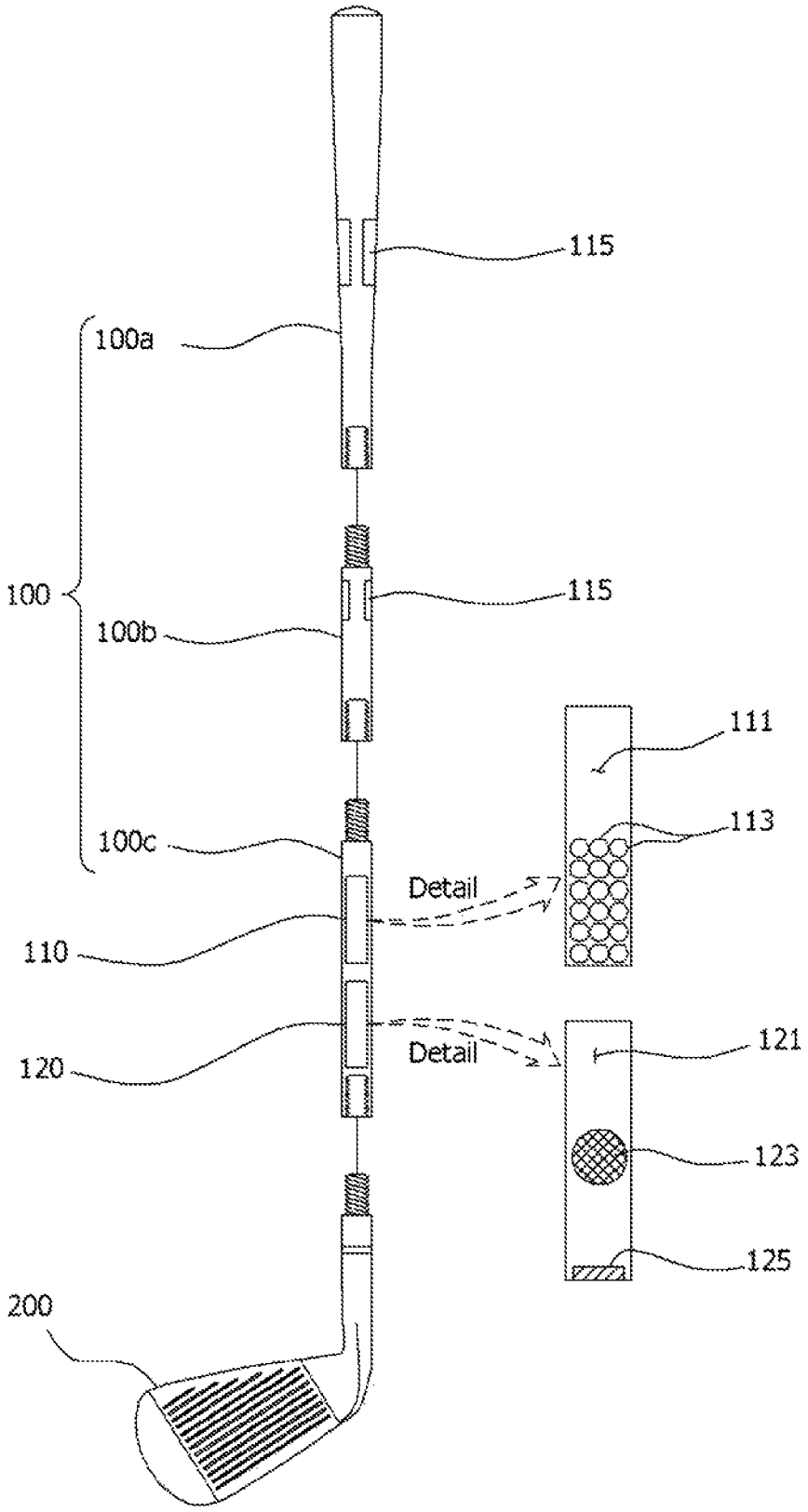
FIG. 1 is an exploded view showing external components and internal components of an educational golf club according to the present invention.
Figure 2:
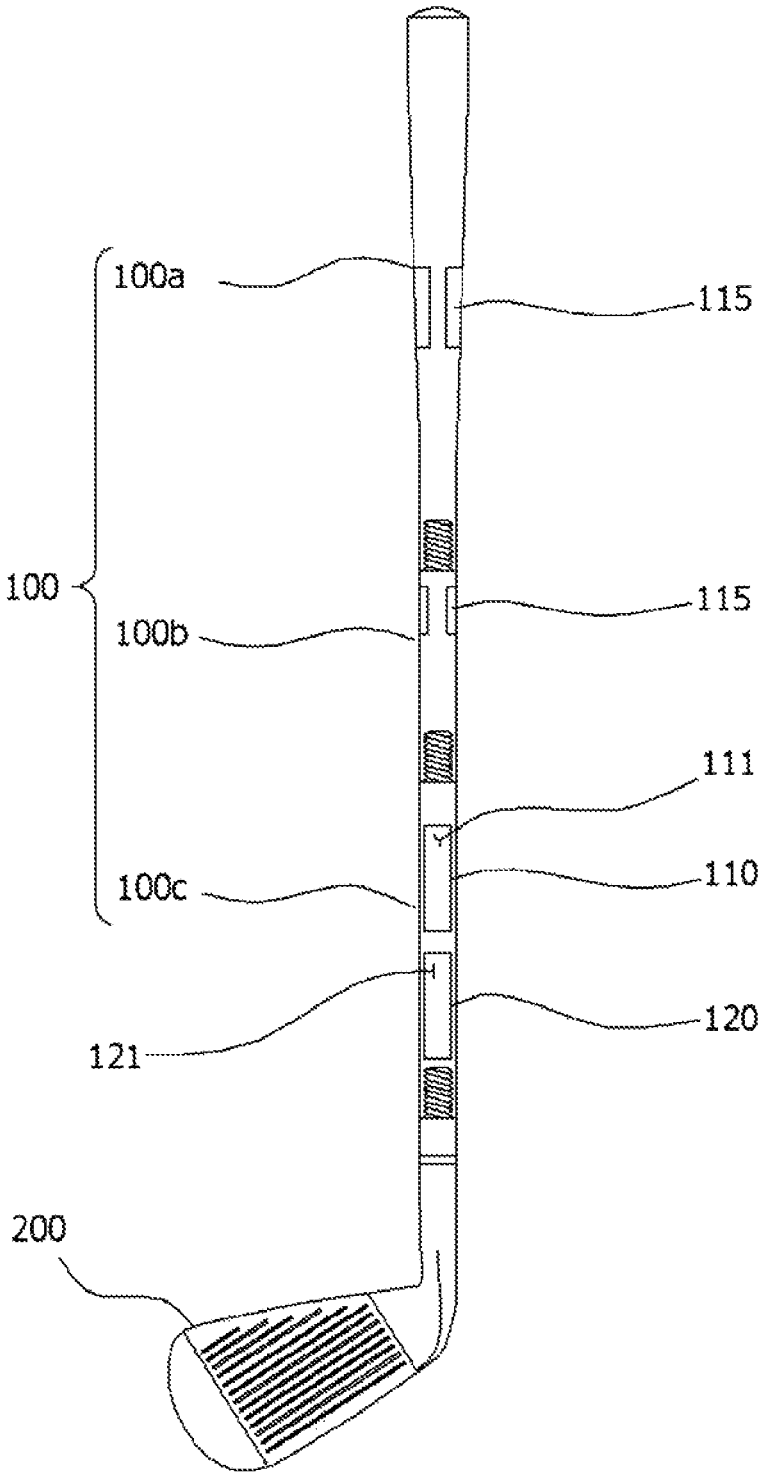
FIG. 2 is a view showing an assembled state of the educational golf club according to the present invention.

FIG. 1 is an exploded view showing external components and internal components of an educational golf club according to the present invention, and FIG. 2 is a view showing an assembled state of the educational golf club according to the present invention.

Referring to FIGS. 1 and 2, the educational golf club according to the present invention includes a shaft 100 and a head 200, and the shaft 100 includes a weight increasing means 110 and a hitting sound generating means 120 disposed therein.

The shaft is formed in a longitudinal direction of the golf club to serve as a body of the golf club. As shown in FIG. 1, the shaft 100 includes a plurality of round bars 100*a*, 100*b* and 100*c* which are coupled with one another to be adjusted in length.

Here, the shaft 100 may be made of one of various materials, such as graphene which is a carbon material, synthetic resin of a plastic material, and metal. Selection of the materials may be achieved depending on use purposes of the golf club.

Furthermore, the shaft 100 has a plurality of grooves 115 formed on the outer circumferential surface or the inner circumferential surface thereof in order to adjust the entire weight of the educational golf club. The location, depth or others of the grooves 115 may be set in various ways depending on the use purposes of the golf club.

The educational golf club according to the present invention can be adjusted in length and weight by the round bars 100*a*, 100*b* and 100*c*, which are standardized with various specifications, and the grooves 115.

In the meantime, the head 200 may be made of one among various materials, such as silicon, synthetic resin and metal.

In the case that the shaft 100 of the educational golf club is made of graphene and the head 200 is made of a lightweight material, such as silicon, the golf club is different from the actual golf club, of which the whole body is made of a metallic material, in weight. Such a difference in weight causes decline of efficiency in practicing golf. Therefore, in the present invention, the weight increasing means 110 is arranged in the shaft 100 in order to make weight of the educational golf club similar to weight of the actual golf club to increase efficiency in practicing golf.

The weight increasing means 110 is characterized by a first space part 111 and a heavy body 113 as shown in FIG. 1.

Here, the weight increasing means 110 may be disposed at a lower portion of the shaft 100 on the basis of the entire length of the shaft 100. That is, the weight increasing means 110 includes the first space part 111 formed in the shaft and the heavy body 113 filling the first space part 111.

Here, the heavy body 113 increases weight of the shaft 100 so that a user feels weight of the educational golf club similar to weight of the actual golf club. The heavy body 113 may be made of various materials, preferably, made of one of synthetic resin, metal, wood, stone, and others.

As described above, the heavy body 113 filling the first space part 111 may be selected from various standardized products with various weights so as to be suitable for the user. The first space part 111 may be formed to be openable through a change in structure so that the user can selectively insert or remove the heavy body 113.

Meanwhile, the educational golf club according to the present invention may additionally include the hitting sound generating means 120 arranged below the weight increasing means 110.

The hitting sound generating means 120 is another characteristic component of the present invention. The hitting sound generating means 120 is formed to generate a hitting sound from the shaft 100 when the user hits the golf ball so as to arouse interest in practicing golf and in golf education.

Here, the hitting sound generating means 120 includes a second space part 121 formed in the shaft 100 and a metallic impacting body 123 moving inside the second space part 121. The hitting sound generating means 120 may further include a metallic impacting protrusion 125 formed at one side thereof to generate a hitting sound when colliding against the impacting body 123.

That is, when the user swings the educational golf club, the impacting body 123 collides against the impacting protrusion 125 by gravity and acceleration applied to the inside of the second space part 121, and a hitting sound is generated by such collision.

Moreover, the hitting sound generating means 120 may further include an elastic member (not shown) to increase movement speed of the impacting body 123. The elastic member includes a spring and a body mounted above or below the second space part 121 so as to apply elastic force conserved at the fastest moment (hitting moment) in the movement speed of the golf club to the impacting body 123.

Furthermore, the second space part 121 may be filled with liquid (not shown) with predetermined weight, and the liquid may be selected as an auxiliary means to generate a sound only at the time of hitting of the golf ball by lowering or preventing movement of the impacting body 123 generated after take-back or swing of the golf club.

Additionally, in order to smoothly transfer the sound generated from the hitting sound generating means 120 to the outside, the shaft 100 may have a plurality of through holes formed in a predetermined space, for instance, the second space part, of the shaft 100.

Meanwhile, in the educational golf club according to the present invention, the shaft 100 and the head 200 may be formed in an integral type or in a detachable type.

Here, in the case that the shaft 100 and the head 200 are formed in the detachable type, the shaft has a spiral groove (not shown) formed at a lower end portion thereof and the head has a spiral thread (not shown) coupled with the spiral groove. The spiral groove and the spiral thread are formed to be coupled with each other in a direction of a hitting side of the golf head to prevent separation of the shaft from the head when the user swings the golf club.

That is, because the educational golf club is designed such that the coupling direction between the spiral groove of the shaft 100 and the spiral thread of the head 200 becomes the hitting side of the head at the time of swing, in spite of repeated swing actions, the educational golf club can prevent an accident caused by separation of the shaft from the head since power is applied in the direction that the shaft 100 and the head 200 are coupled continuously.

Meanwhile, a grip of a grasped part may be made of rubber, silicon, synthetic resin, EVA or compressed sponge, and the golf ball, which is released in pairs with the educational golf club, may be made of rubber, synthetic resin, silicon or compressed sponge. In this instance, another heavy body, which is made of metal, wood, stone, or others, may be arranged inside the golf ball so as to provide the golf ball with various weights depending on the user's age, height or other physical conditions.

As described above, the educational golf club according to the present invention may be in a wide use since being adjusted in weight or length according to the user's height or age.

Additionally, the educational golf club according to the present invention can arouse interest in golf by being formed to generate a hitting sound from the shaft realistically when the user hits the golf ball.

As described above, while the present invention has been particularly shown and described with reference to the example embodiments thereof, it will be understood by those of ordinary skill in the art that the technical idea of the present invention is not limited by the embodiments and various changes, modifications and equivalents may be made therein without changing the technical idea and the scope of the claims of the present invention.

What is claimed is:

1. An educational golf club pairing with an educational golf ball, the educational golf club comprising:

a shaft made of graphene or synthetic resin, the shaft comprising:

a first, a second, and a third round bars, which are coupled with one another to be adjusted in length of the shaft;

a plurality of grooves formed on an outer circumferential surface or an inner circumferential surface of the first and the second round bars in order to adjust an entire weight of the educational golf club;

a weight increasing means disposed inside the third round bar, the weight increasing means having a first space part which is openable and formed in the third round bar, and a heavy body filling the first space part, wherein the heavy body is made of one from the group consisting of synthetic resin, metal, wood, and stone; and a hitting sound generating means arranged below the weight increasing means, both of the weight increasing means and the hitting sound generating means disposed inside the third round bar, the hitting sound generating means having a second space part formed in the third round bar and filled with liquid with predetermined weight, an impacting body movable inside the second space part, an impacting protrusion formed at one side of the second space part to generate a hitting sound when colliding against the impacting body, and an elastic member to increase movement speed of the impacting body when a user swings the educational golf club; and a golf club head made of silicon, wherein the shaft and the golf club head are formed integrally or detachably with each other, wherein, when the shaft and the golf club head are formed detachably with each other, the shaft has a spiral groove formed at a lower end portion thereof and the golf club head has a spiral thread coupled with the spiral groove, wherein the spiral groove and the spiral thread are formed to be coupled with each other in a direction of a hitting side of the golf club head to prevent separation of the shaft from the golf club head when the user swings the educational golf club, and the educational golf ball made of rubber, synthetic resin, silicon or compressed sponge.

* * * * *